United States Patent [19]

Volk

[11] Patent Number: 4,679,500

[45] Date of Patent: Jul. 14, 1987

[54] PRINTER WITH PLURAL ENDLESS BANDS AND STOP MEANS THEREFOR

[75] Inventor: Heinrich Volk, Beerfelden-Gammelsbach, Fed. Rep. of Germany

[73] Assignee: Esselte Meto International GmbH, Fed. Rep. of Germany

[21] Appl. No.: 757,432

[22] Filed: Jul. 22, 1985

[30] Foreign Application Priority Data

Jul. 27, 1984 [DE] Fed. Rep. of Germany ..... 3427858

[51] Int. Cl.[4] ..... B41J 1/20; B41K 1/10

[52] U.S. Cl. ..... 101/111; 101/105

[58] Field of Search ..... 101/105, 111

[56] References Cited

U.S. PATENT DOCUMENTS 1,058,008 4/1913 Standley ..... 101/111

4,290,358 9/1981 Hamisch, Jr. ..... 101/111

FOREIGN PATENT DOCUMENTS 2064435 11/1979 United Kingdom ..... 101/111

*Primary Examiner*—Edgar S. Burr

*Assistant Examiner*—Tonya Lamb

*Attorney, Agent, or Firm*—Gerald J. Ferguson; Ronni S. Malamud; Michael P. Hoffman

[57] ABSTRACT

A printing mechanism (10) includes a plurality of setting wheels (16) which are rotatably mounted about a common axis and with which endless printing bands (20) are in drive connection which carry in a region of their length at the outer surface printing types (22) and in another region of their length carry at the outside indicating types (24). The printing bands (20) are led round the setting wheels (16) and a deflection edge (18) spaced therefrom. By turning the setting wheels (16) said bands are adjustable. In another region of their length they are provided at the inner surface with teeth (50) for engaging in corresponding recesses (52) in the setting wheels. A setting shaft (42) carrying an actuating knob (48) can be brought into a drive connection with the setting wheels (16). To limit the turning angle of the setting wheels (16) stop means are provided which include stop shoulders (74, 78) disposed in the path of movement of the tooth (50) lying at the front in the particular adjustment direction of the printing bands (20). The stop shoulders are disposed directly adjacent the deflection edge (18).

4 Claims, 2 Drawing Figures

PRINTER WITH PLURAL ENDLESS BANDS AND STOP MEANS THEREFOR

BACKGROUND OF THE INVENTION

1. Technical Field

The invention relates to a printing mechanism comprising a plurality of setting wheels which are mounted rotatably about a common axis and with which endless printing bands are in a drive connection which carry in a region of their length at the outer surface printing types and in another region of their length at the outer surface indicating types and which are led about the setting wheels and about a deflection edge arranged spaced therefrom and which are adjustable by turning the setting wheels, the printing bands being provided in the other region of their length at the inner face with teeth for engagement in corresponding recesses in the setting wheels, a setting shaft adapted to be brought into a drive connection with each of the setting wheels and carrying an actuating knob and stop means for limiting the turning angle of the setting wheels which comprise stop shoulders disposed in the path of movement of the tooth lying at the front in the respective adjustment direction of the printing bands.

2. The Prior Art

Such a printing mechanism is described in patent application No. P 34 06 762.0. When using the printing mechanism the printing types which are disposed at a predetermined printing position are inked in each case before the actual operation and then brought into contact with the medium to be imprinted. The display or indicating types are associated in their position with the printing types on the bands in such a manner that for each printing type which happens to be disposed in the printing position a corresponding indicating type is disposed in a display position and is visible to the operator so that the operator can see which character can be printed with the printing type at that instant in the printing position. For reasons of good legibility the indicating types are generally disposed on a white background. If the setting wheels could be turned with the aid of the setting shaft to any desired extent it could easily happen that the indicating types mistakenly reach the printing position and are inked with printing ink. It would then also be possible for printing ink to get onto the bright background of the indicating types so that the latter would then not easily be legible. The stop shoulders provided in this printing mechanism prevent in conjunction with the respective front teeth in the turning direction unintentional inking of the indicating types by limiting the turning angle of the setting wheels so that the indicating types cannot move into the printing position.

To make it impossible by forceful further turning of the setting wheels in the printing mechanism according to patent application No. P 35 06 762.0 for the printing bands to be adjusted to such an extent that the front tooth in the adjustment direction runs beyond the stop shoulder and indicating types undesirably reach the printing position, the actuating knob mounted on the setting shaft is coupled to the latter via a slip coupling. This slip coupling or clutch is so dimensioned that it slips, i.e. cannot transmit any higher torque to the setting shaft, after the front tooth in the adjustment direction has come to bear on the associated stop shoulder. The dimensioning of the slip coupling is a critical point. On the one hand, the actuating knob must be mounted so firmly on the adjusting shaft that it is completely impossible for it to slip too early, which would make normal turning of the printing bands for obtaining the desired setting operations no longer possible. On the other hand, it must engage lightly enough to ensure that it slips before the leading tooth in the adjustment direction can run past the stop shoulders, and this means that it must not slip too late. These contrasting requirements make a compromise necessary which leads to tolerance problems in dimensioning the slip coupling. In the printing mechanism described the slip coupling is formed in that the actuating knob is made from elastically deformable material and that the setting shaft is mounted in an axial bore in the actuating knob whose internal diameter in the condition detached from the setting shaft is less than the external diameter of the portion of the setting shaft intended for insertion into said bore. This gives tolerance problems in particular as regards keeping to the internal diameter of the bore of the actuating knob.

The invention is based on the problem of further developing a printing mechanism of the type outlined in such a manner that the problems occurring in conjunction with using a slip coupling are eliminated.

SUMMARY OF THE INVENTION

According to the invention this problem is solved in that the stop shoulders are disposed directly adjacent the deflection edge.

The shifting of the stop shoulders to the immediate vicinity of the deflection edge has the effect that the force expenditure which would be necessary to turn the leading tooth in the turning direction beyond the stop shoulder is substantially greater than the force expenditure necessary for excessive turning of a stop shoulder more remote from the deflection edge. In this manner, the stop shoulders adjoining the deflection edge on their own provide adequate means for restricting the turning angle of the setting wheels with great reliability. The slip coupling retained between the actuating knob and the setting shaft can be designed for a substantially higher slip torque, thus excluding with certainty said slip coupling from beginning to slip too early due to tolerances in the dimensioning of the actuating knob and printing bands thus from not being further turnable in the execution of normal adjustment operations. The attachment of the stop shoulders directly at the deflection edge gives this advantageous effect.

Advantageous further developments of the invention are characterized in the claims. The further development according to claim 2 resides in that at least in the region of a stop shoulder in association with the outer surface of the printing bands a web is disposed which is spaced from the stop shoulder a distance which is smaller than the height of at least the leading tooth in each adjustment direction of the printing band plus the printing band thickness. By this further development in the region of a stop shoulder a gap is formed which is so narrow that the printing band with the tooth disposed on its inner surface cannot possibly move through said gap. As a result, even when a very large torque is applied indicating types are prevented with certainty from moving into the printing position and undesirably being inked.

The further development according to the claims resides in that the height of at least the front teeth in each adjustment direction of the printing band is greater than the printing band deflection possible due to the elasticity of the printing band in the region of the stop shoulders.

Because of this dimensioning it is completely impossible for the printing band in the region of the stop shoulders to be stretched to such an extent that the tooth bearing on the stop shoulder slips over the latter and this also prevents with certainty a further turning of the printing band.

BRIEF DESCRIPTION OF THE DRAWINGS

An example of embodiment of the invention will now be described with reference to the drawings, wherein.

DETAILED DESCRIPTION OF THE PREFERRED EMBODIMENTS

Figure 1:
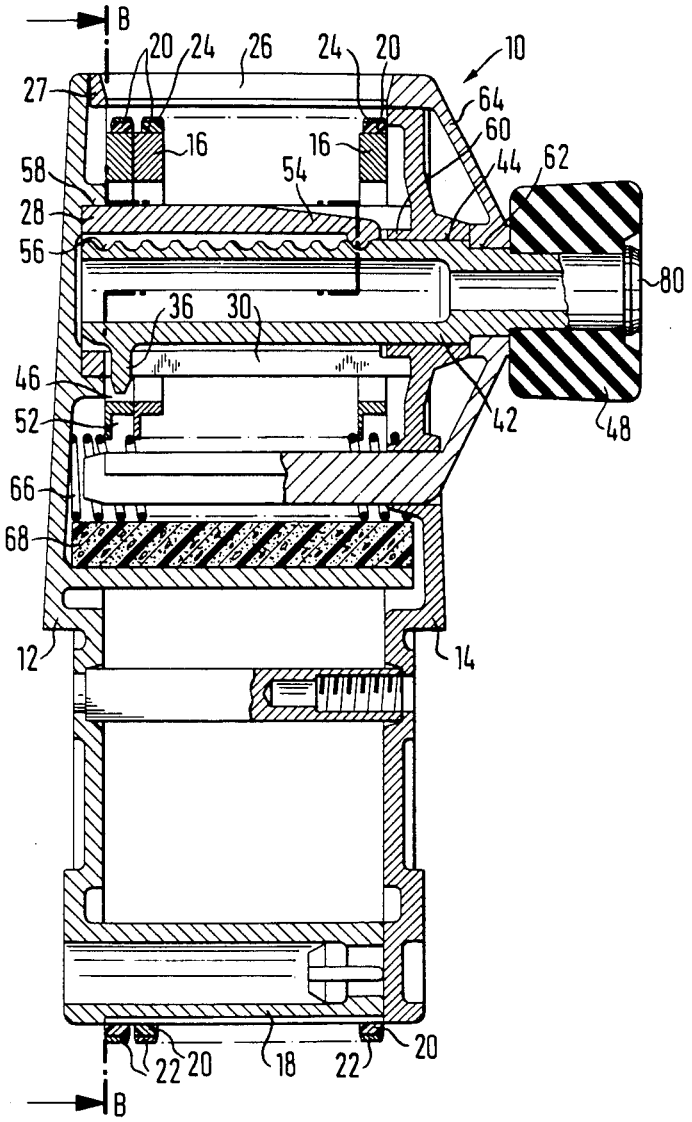
FIG. 1 shows the printing mechanism according to the invention in section along the line A—A of FIG. 2

The printing mechanism 10 illustrated in FIG. 1 comprises a printing mechanism housing which is made up of two housing halves 12 and 14 and in which a plurality of parallel adjacent printing bands 20 led round setting wheels 16 and a deflection edge 18 is accommodated. The printing bands 20 carry on one half of their outer peripheral surface printing types 22 and on the other half display or indicating types 24. The association of the printing types 22 with the indicating types 24 is such that printing types 22 disposed in the printing position at the deflection edge 18 as in FIG. 2 and indicating types 24 visible through a window 26 arranged at the housing upper side always represent the same number, letter or the like. This means that at the housing upper surface it can be seen through the window 26 which character can be printed on a recording carrier with the printing types 22 disposed below at the deflection edge.

Figure 2:
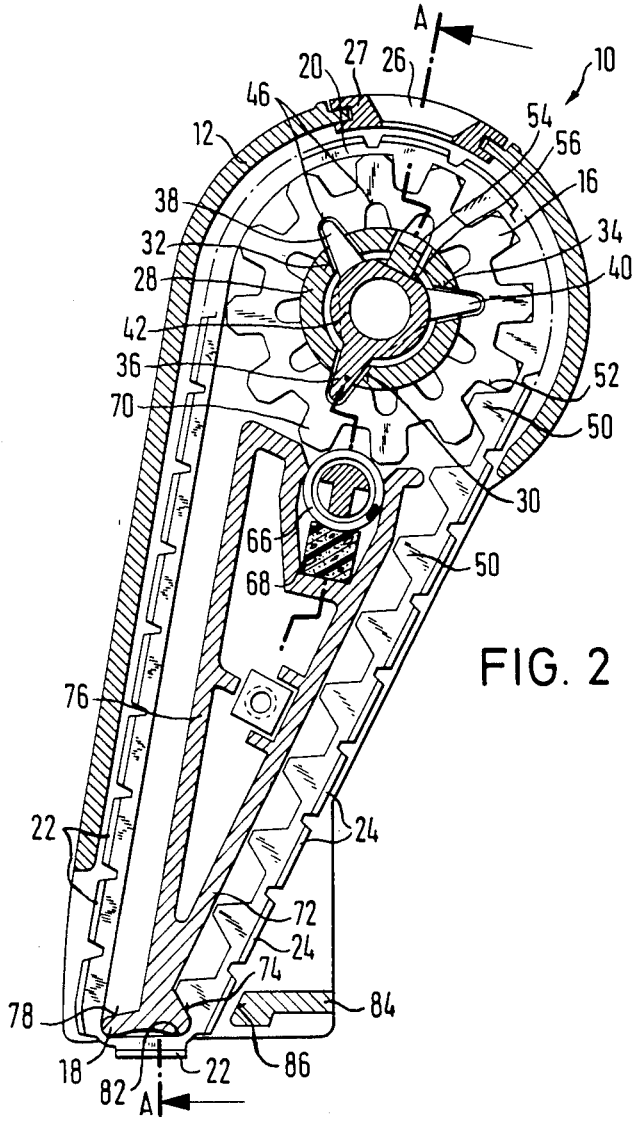
FIG. 2 shows the printing mechanism of FIG. 1 in section along the line B—B of FIG. 1.

As already mentioned, the printing bands 20 are led round setting wheels 16 which are rotatably mounted on a sleeve 28. The sectional view of FIG. 2 shows that in the sleeve 28 three slots 30, 32 and 34 are disposed which are open on the sleeve end lying on the right in FIG. 1. Through said slots three teeth 36, 38 and 40 engage which are disposed on a setting shaft 42. The setting shaft 42 is axially displaceable in a bearing bush or passage 44 in the housing half 14. By displacement of the setting shaft 42 in the axial direction, by engagement of the teeth 36, 38 and 40 in recesses 46 in the hub regions of the setting wheels 16 said shaft can be brought into a drive connection with said wheels. In FIG. 2 the engagement of the teeth 36, 38 and 40 in the recesses 46 of a setting wheel 16 can be seen.

Mounted on the end of the setting wheel 42 projecting from the housing is an actuating knob 48 with the aid of which the shaft can firstly be axially displaced and secondly rotated. By the axial displacement of the setting shaft 42 the teeth 36, 38 and 40 disposed thereon are first brought into engagement with the recesses 46 of a setting wheel 16 to be adjusted and by turning the setting shaft 42 the printing band led round the outer periphery thereof is moved until a desired printing type 22 is in the printing position beneath the deflection edge 18. As already mentioned, the respective position of the printing types 22 can be checked through the window 22 disposed at the top of the housing. To obtain a drive connection between the printing bands 20 and the setting wheels 16 said printing bands 20 comprise at their inner surface teeth 50 which engage in recesses 52 at the outer peripheral faces of the setting wheels 16.

To obtain an exact alignment of the plane of the teeth 36, 38 and 40 with the plane of the setting wheel 16 to be adjusted a detent mechanism is provided which ensures that the setting shaft on its axial displacement always engages in a manner clearly noticeable to the operator in positions in which a clear drive connection is established with the setting wheel 16 to be adjusted. This detent mechanism includes a detent finger 54 which is formed integrally on the sleeve 28 and which projects at the sleeve inner surface radially inwardly and engages in detent recesses 56 which are provided in a region of the outer peripheral surface of the setting shaft 42. A detent recess 56 is provided for each of the setting wheels 16 mounted on the sleeve 28. If in the arrangement of the individual parts illustrated in FIG. 1 in which the setting shaft 42 is in engagement with the setting wheel 16 on the extreme left said setting shaft 42 is moved to the right in order to come into engagement for example with the nearest setting wheel 16, firstly the detent force exerted by the detent finger 54 on the setting shaft 42 must be overcome when it moves upwardly out of the associated detent recess 56 in the illustration of FIG. 1; thereafter, it can drop into the next detent recess 56 and this happens exactly when the setting shaft 52 is in engagement with the second setting wheel 16 from the left.

Since the slit sleeve 28 serves as bearing axis for the setting wheels 16, particular attention must be devoted to its mounting and arrangement in the printing mechanism. Firstly, the sleeve 28 must have as constant an outer diameter as possible for mounting the setting wheels 16 and secondly it must also have an exactly defined internal diameter to enable the setting shaft 42 to be easily displaced axially without jamming. On one side, the side on the left in FIG. 1, the sleeve 28 is disposed in a circular cylindrical recess 58. Since the slots 30, 32 and 34 do not pass through this side of the sleeve 28 at this point the mounting of the sleeve 28 at its outer side is adequate. On the other side, the side on the right in FIG. 1, the sleeve segments formed by the through slots 30, 32 and 34 rest on a hub 60 formed on the housing portion 14. The hub 60 ensures that the sleeve 28 has at the associated end in spite of the through slots the necessary stability for mounting the setting wheels 16. The hub 60 keeps the slots spaced apart so that the teeth 36, 38 and 40 can be moved easily along the slots without jamming.

As apparent from FIG. 1 the setting shaft 42 extends in the portion directly adjoining the actuating knob 48 through the passage or bushing 62 disposed in a conical cap 64. Among other things the purpose of this cap is to ensure a smooth covering of the upper portion of the printing mechanism 10. However, it also carries a frame 27 which surrounds the window 26 and which is displaceably mounted on the housing; the nature of the mounting is apparent from FIG. 2. When the setting shaft 42 is axially displaced the frame 27 moves with the window 26 and the end of the inspection window on the left in FIG. 1 always lies exactly in the plane of the setting wheel 16 with which the setting shaft 42 is in engagement and which can accordingly be adjusted. By observation of the left end of the window 26 the operator thus knows in every axial position of the setting shaft 42 which printing band can be brought into the desired position.

To enable the operator on turning the setting wheels and thus positioning the printing bands to carry out the individual adjustment operations always until a printing type 22 is disposed exactly in the printing position at the deflection edge 14 a further detent mechanism is provided which facilitates the exact setting for the operator. This detent mechanism consists of a helical spring 66 which is disposed parallel to the longitudinal axis of the setting shaft 42 at the periphery of the setting wheels 16 in such a manner that it partially penetrates the recesses 52 at the periphery of the setting wheels 16 as can clearly be seen from FIG. 2. To enable the setting wheels 16 to be turned although the helical spring 66 engages in accordance with FIG. 2 in its recesses said helical spring 66 is mounted on a resiliently yieldable cushion 68. On rotation of the setting wheels 16 the helical spring 66 can yield in this manner and press itself into the cushion 68. The operator thereby feels on turning the setting wheels from the position shown in FIG. 2 into the position in which a tooth 70 is moved between the recesses 52 towards the helical spring 66 firstly an increase of the turning force to be applied which then decreases again when the helical spring penetrates the next recess 52. The operator thus feels pronounced force peaks and knows that whenever he has overcome a force peak a printing type 22 is in the exact printing position beneath the deflection edge 18.

As already mentioned, at the outer periphery of the printing bands 20 in one length section printing types 22 are disposed and in another length section indicating types 24. When using the printing mechanism the printing types are first inked before each printing operation, whereupon the inked printing types are then brought into contact with the medium to be imprinted. Through the window 26 it can be seen from the indicating types 24 which characters can be printed on the medium to be imprinted in that particular setting of the printing bands. During operation of the printing mechanism it must be avoided that the indicating types 24 during adjustment of the printing bands come into a position beneath the deflection edge 18 in which they could come into contact with the inking mechanism used to ink the printing types. The undesired inking would greatly impair the legibility of the indicating types 24 in the window 26. It must therefore be ensured that the printing bands 20 can always be moved only to such an extent that although all the printing types 22 can reach the printing position beneath the deflection edge 18 this position cannot be reached by the respective associated indicating types 24. The means for preventing the complete turning of the printing bands 20 include the teeth 50 which are disposed on a portion of the inner peripheral surface of the printing bands 20 and which are also used for driving the printing bands 20 by engagement in the recesses 46 in the setting wheels 16. As apparent from the sectional view of FIG. 2 the housing comprises in the region within the printing bands 20 a web 72 extending parallel to said printing bands 20 and disposed a distance therefrom such that the teeth 50 can move unrestricted therealong. At the end lying near the deflection edge 18 the web 72 comprises however a stop shoulder 74 which directly adjoins the deflection edge 18 and which is so formed that the front tooth 50 in the direction of movement strikes in its full height against said stop shoulder 74 when it reaches the region of the deflection edge 18. Said stop shoulder 74 prevents the region of the outer peripheral surface of the printing bands 20 carrying the indicating types 24 from reaching the printing position beneath the deflection edge 18. As apparent from FIG. 2 the indicating types 24 are in the region of the outer peripheral surface of the printing bands 20 in which the teeth 50 are disposed on the inner peripheral surface. The web 72 and the stop shoulder 74 limit the turning of the printing bands 20 in the illustration of FIG. 2 in the clockwise direction, FIG. 2 showing a limit position which the printing bands 20 can reach. To limit the rotation of the printing bands 20 in the other direction, i.e. anticlockwise in FIG. 2, a second web 76 is disposed on the housing and also comprises a stop shoulder 78 immediately adjacent the deflection edge 18. Said stop shoulder 78 prevents rotation of the printing bands 20 beyond a limit position which is present when the front tooth 50 on rotation clockwise strikes against the stop shoulder 78.

Since the printing bands 20 and the teeth 50 disposed on their inner surface are made from deformable material said printing bands 20 could on exertion of an excessive force on rotating the setting shaft 42 possibly, with deformation of the teeth 50, be turned beyond the limit positions defined on either side of the deflection edge 18 and this would have the undesirable consequence of the indicating types coming into contact with the printing ink. To avoid this undesirable "overrunning" of the stop shoulders 74 and 78 the actuating knob 48 is not connected in form-locking manner to the setting shaft 42 but in force-locking manner. The force-locking connection is obtained by fitting the actuating knob 48 with push-fit onto the end of the setting shaft 42 projecting out of the housing and the push-fit is so dimensioned that although the torque transferable by the actuating knob 48 to the setting shaft 42 suffices to adjust the printing bands 20 the actuating knob 48 slips on the setting sh.fat 42 as soon as the printing band 20 being adjusted reaches its limit position in which the leading tooth 50 in the particular adjustment direction comes to bear on the stop shoulder 74 or 78. The desired push-fit can be achieved in simplest manner by making the actuating knob 48 from a rubber-elastic material such as Vulkollan and forming the bore disposed therein for receiving the setting shaft 42 with an internal diameter which is smaller than the external diameter of the end of the setting shaft 42 projecting at the housing. Because of the elasticity of the material Vulkollan and the actuating knob 48 can easily be pushed onto the setting shaft 42 and can even be pushed over the widened shaft end 80 apparent in FIG. 1, which prevents said knob from sliding off again after attachment. The connection between the actuating knob 48 and the setting shaft 42 is provided by a slip coupling which slips as soon as the resistance moment of a printing band 20 being adjusted counteracting the turning movement is greater than the torque transferable by the actuating knob 48 to the setting shaft 42. This occurs with certainty when the printing band 20 to be adjusted reaches one of its limit positions.

If in the limit position of the printing band illustrated in FIG. 2 an excessive torque is exerted on the setting shaft 42 which tends to move the printing band 20 beyond the illustrated limit position, unless further precautions were taken it could occur that the front tooth 50 in the adjustment direction tilts round the stop shoulder 74, the nose 82 of the stop shoulder 74 acting as fulcrum. However, for this to occur the printing band 20 must be deflected in the region of the stop shoulder 74 to such an extent that the tooth 50 can slip round the nose 82. To prevent this, the height of the tooth 50 plus the thickness of the printing band 20 is so dimensioned that it is greater than the printing band deflection which is possible due to the elasticity of the printing band in the region of the stop shoulder 74. It should be noted that this possible deflection is very small because to obtain a good setting precision the printing bands should have as little as possible inherent elasticity. However, a certain residual elasticity cannot be avoided in the printing band production and consequently a certain deflection is possible. As described, however, the deflection cannot take place to such an extent that an overturning of the printing band occurs. This even makes it possible to omit the slip coupling provided between the actuating knob 48 and the setting shaft 42 which means that the actuating knob 48 could be fixedly connected to the setting shaft 42. If the slip coupling is retained the tolerance problems in the production of the actuating knob 48 are almost completely eliminated because the limit torque at which slipping occurs can be made very high.

As further securing against undesirable overturning of the printing bands a web 84 is disposed at the housing half 12 and comprises an end edge 86 which is spaced from the stop shoulder 74 such that the gap between it and said shoulder 74 is smaller than the height of the tooth 50 plus the thickness of the printing band. If by applying excessive adjustment force the tooth 50 bearing on the stop shoulder 74 attempts to slip round the nose 82 at the stop shoulder 74 the web 84 with its end face 86 prevents further turning of the printing band 20 because the narrow gap makes it impossible for the tooth 50 on the printing band 20 to pass through. This measure also contributes to greatly reducing the tolerance requirements made of the slip coupling between the actuating knob 48 and the setting shaft 42. The actuating knob 48 may be mounted so firmly on the setting shaft 42 that the normal adjustment operations of the printing bands are always possible even if the torque to be applied for the adjustment should increase after longer periods of use due to soiling.

I claim:

1. Printing mechanism comprising a plurality of setting wheels which are mounted rotatably about a common axis and with which endless printing bands are in a drive connection which carry printing types in a region of their length at the outer surface and indicating types in another region of their length at the outer surfaces and which are led about the setting wheels and about a deflection edge arranged spaced therefrom and which are adjustable by turning the setting wheels, the printing bands being provided with a plurality of teeth in said another region of their length at the inner surface thereof for engagement in corresponding recesses in the setting wheels, said mechanism further comprising a setting shaft adapted to be brought into a drive connection with each of the setting wheels, said setting shaft carrying an actuating knob, and said mechanism further comprising stop means for limiting the turning angle of the setting wheels, said stop means comprising stop shoulders disposed in the path of movement of the tooth lying in front of the plurality of the teeth when regarded in the respective adjustment direction of the printing bands, characterized in that the stop shoulders are disposed directly adjacent the deflection edge and the height of at least the teeth lying in front of the plurality of the teeth in each adjustment direction of the printing bands is greater than the printing band deflection possible due to the elasticity of the printing band in the region of the stop shoulder, and a web is disposed at least in the region of the stop shoulder in the association with the outer surface of the printing bands, said web being spaced from the stop shoulder a distance which is smaller than the height of at least the tooth lying in front in each adjustment direction of the printing band plus the printing band thickness.

2. Printing mechanism according to claim 1 wherein said plurality of teeth are provided only in said another region of the length of the printing bands.

3. A printing mechanism comprising:

a plurality of setting wheels mounted rotatably about a common axis;

a deflection edge spaced a distance from said plurality of printing wheels;

at least one endless printing band having an inner surface and an outer surface, said at least one printing band comprising at least one printing type extending along a first portion of the at least one printing band on an outer surface thereof and at least one indicating type extending along a second portion of the at least one printing band on the outer surface thereof, said at least one printing band being positioned about said plurality of setting wheels and said deflection edge and being adapted to be adjusted by said plurality of setting wheels;

at least one tooth positioned on said inner surface and extending along said second portion for engagement in corresponding recesses in said plurality of setting wheels;

a setting shaft drivably connectable to each of said plurality of setting wheels comprising an actuating knob;

stop means for limiting the turning angle of said plurality of setting wheels, said stop means comprising stop shoulders disposed directly adjacent to said deflection edge such that a first one of said at least one teeth will abut one of said stop shoulders as said at least one printing band is adjusted in each direction, at least said first one of aid at least one teeth having a height which is greater then an amount of deflection of said at least one printing band possible due to elasticity of said at least one printing band near said stop shoulders, and further comprising a web disposed near one of said stop shoulders and spaced a predetermined distance from said one of said stop shoulders, said predetermined distance being less than the thickness of one of said at least one teeth and the printing band.

4. The printing mechanism according to claim 3 wherein said at least one tooth comprises a plurality of teeth extending only along said second portion of said at least one printing band.

* * * * *